US008002224B2

(12) United States Patent
Hamann

(10) Patent No.: US 8,002,224 B2
(45) Date of Patent: Aug. 23, 2011

(54) ADJUSTABLE PEDESTAL SUPPORT

(75) Inventor: Michael E. Hamann, Effingham, IL (US)

(73) Assignee: BK Resources, Inc., Effingham, IL (US)

( * ) Notice: Subject to any disclaimer, the term of this patent is extended or adjusted under 35 U.S.C. 154(b) by 437 days.

(21) Appl. No.: 11/946,401

(22) Filed: Nov. 28, 2007

(65) Prior Publication Data

US 2009/0134307 A1 May 28, 2009

(51) Int. Cl.
*F16M 11/24* (2006.01)

(52) U.S. Cl. ..... 248/188.4; 248/650

(58) Field of Classification Search ..... 248/188.5, 248/649, 650, 673, 188.2, 188.4, 188.9, 188.8, 248/677, 151; 62/440; 411/82, 176
See application file for complete search history.

(56) References Cited

U.S. PATENT DOCUMENTS

| | | | | |
|---|---|---|---|---|
| 1,096,216 | A * | 5/1914 | Beehler | 135/74 |
| 2,783,583 | A | 3/1957 | Holmquist | |
| 2,931,128 | A | 4/1960 | Hiers et al. | |
| 2,940,784 | A * | 6/1960 | Fell | 74/89.35 |
| 3,041,777 | A | 7/1962 | Schwartz | |
| 3,104,493 | A * | 9/1963 | Nalle | 248/188.4 |
| 3,131,505 | A | 5/1964 | Cruikshank | |
| 3,191,212 | A | 6/1965 | Reiss, Sr. et al. | |
| 3,669,393 | A | 6/1972 | Paine et al. | |
| 3,742,552 | A * | 7/1973 | Balchunas | 16/42 R |
| 4,313,586 | A | 2/1982 | Grzesnikowski | |
| 4,789,121 | A | 12/1988 | Gidseg et al. | |
| 5,040,758 | A | 8/1991 | Giovannetti | |
| 5,092,550 | A | 3/1992 | Bettini | |
| 5,153,052 | A * | 10/1992 | Tanaka et al. | 428/212 |
| 5,169,259 | A * | 12/1992 | Cornell et al. | 403/309 |
| 5,536,068 | A | 7/1996 | Valentor et al. | |
| 5,881,979 | A | 3/1999 | Rozire, Jr. et al. | |
| 6,027,086 | A | 2/2000 | Heitlinger et al. | |
| 6,196,505 | B1 | 3/2001 | Wainwright | |
| 6,407,351 | B1 * | 6/2002 | Meyer et al. | 177/238 |
| 6,478,270 | B2 | 11/2002 | Parisi et al. | |
| 6,520,461 | B1 | 2/2003 | Graham | |
| 6,796,011 | B2 | 9/2004 | Takeuchi et al. | |
| 6,968,583 | B1 * | 11/2005 | Rich | 5/509.1 |
| 7,234,200 | B2 * | 6/2007 | Chase | 16/42 R |

FOREIGN PATENT DOCUMENTS

JP 05010658 A * 1/1993

* cited by examiner

*Primary Examiner* — Gwendolyn Baxter
(74) *Attorney, Agent, or Firm* — Wildman, Harrold, Allen & Dixon LLP

(57) ABSTRACT

An adjustable support which includes a housing constructed of a sidewall wherein a column is positioned within the housing and spaced apart from the sidewall and wherein the column defines threads. A leg is also provided which is constructed of another sidewall which defines other threads wherein the other threads are dimensioned to engage the threads defined by the column.

14 Claims, 4 Drawing Sheets

ADJUSTABLE PEDESTAL SUPPORT

FIELD OF INVENTION

This invention relates to the field of legs used as the base of equipment and furniture and the like and more particularly, legs that are height adjustable.

SUMMARY OF THE INVENTION

In one example of the adjustable support, a housing constructed of a sidewall is provided. A column is positioned within the housing and spaced apart from the sidewall. The column defines threads. A leg is also provided which is constructed of another sidewall which defines other threads wherein the other threads are dimensioned to engage the threads of the column.

BRIEF DESCRIPTION OF THE DRAWINGS

Certain examples of the present invention are illustrated by the accompanying figures. It should be understood that the figures are not necessarily to scale and that details that are not necessary for an understanding of the invention or that render other details difficult to perceive may be omitted. It should be understood, of course, that the invention is not necessarily limited to the particular examples illustrated herein.

DETAILED DESCRIPTION

Figure 1:
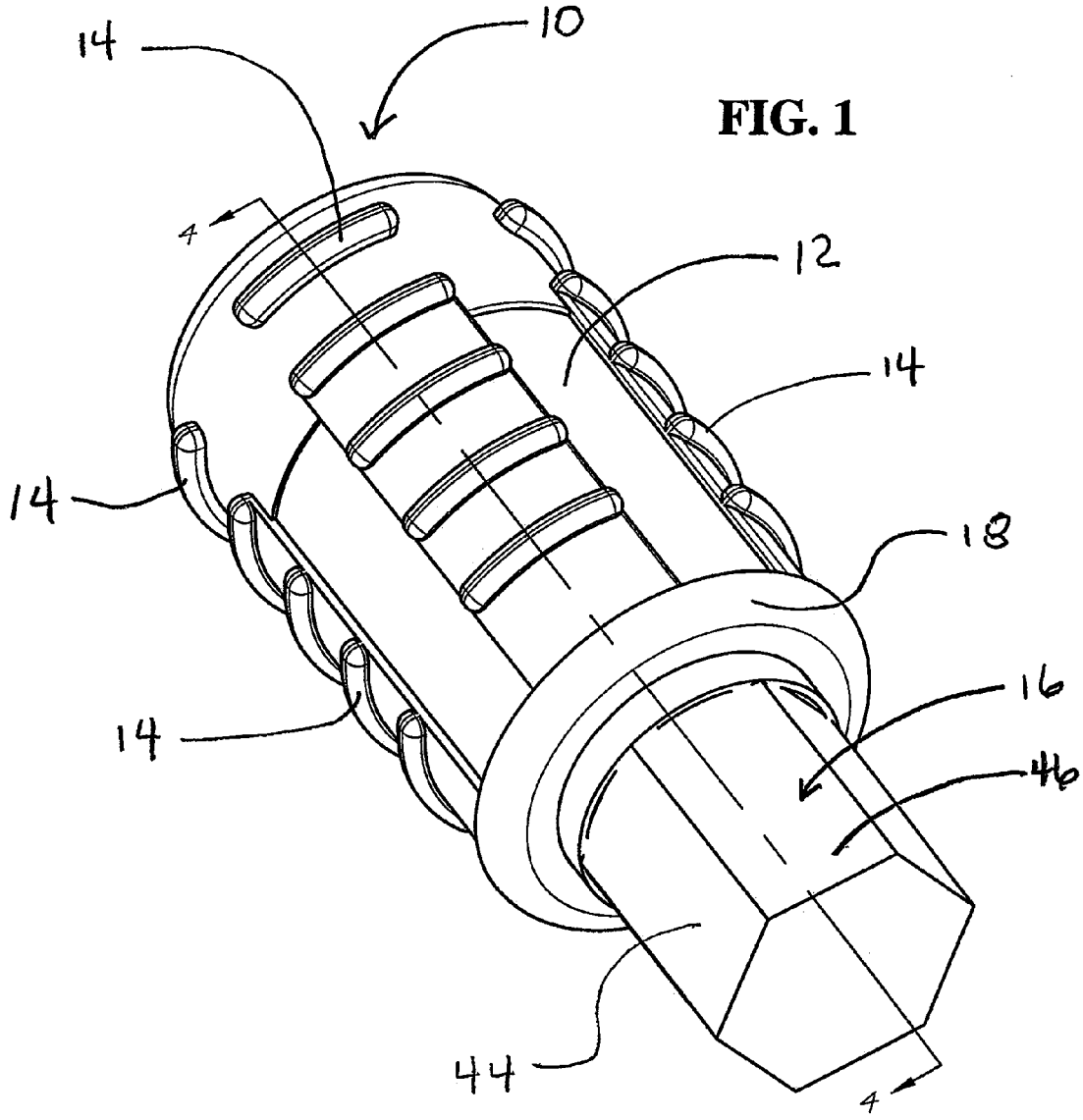
FIG. 1 is a perspective view of one example of an adjustable support assembly

Referring to FIG. 1, an example of an adjustable support 10 is shown. Housing 12 is the portion of support 10 which is used to engage a lower portion of the equipment or furniture that is to be supported by support 10. Typically, housing 10 will be inserted into an opening or channel which will have sidewalls therein, of a piece of furniture or equipment, wherein the sidewalls will engage ribs 14 that are positioned on the exterior of housing 12. In this example, ribs 14 are integrally formed into housing 12. The size of the opening or channel in the furniture or equipment provides a secure jam fit against ribs 14 thereby providing a stable engagement of support 10 to the equipment or furniture it supports. Leg assembly 16 is positioned at the lower portion of support 10 and is adjustable lengthwise relative to housing 12, which will be discussed in more detail herein. An annular ring 18 is secured to a lower portion of housing 12 and, as will also be discussed in more detail herein, will limit the amount of travel of leg assembly 16 outwardly from housing 12.

Adjustable support 10 will be required to carry a wide variety of loads. Such loads often will range from about 100 lbs. to 500 lbs. In the example shown in FIG. 1, housing 12 is constructed of polypropylene, wherein the density may range from about 0.90 g/cc to 0.92 g/cc which provides needed strength, flexibility and durability for support 10 under high load capacities. In this example, the gauge or wall thickness of housing 12 is 0.80". The wall thickness may range from about 0.80" to 0.100" which can readily handle loads of about 100 lbs. to 500 lbs. Thus, the gauge or wall thickness of the construction of housing 12 may be varied to suit the load capacity to be experienced by support 10. Leg assembly 16 and annular ring 18, in this example, may be constructed of a number of suitable materials such as polypropylene and/or metal such as stainless steel, aluminum and the like. It is understood the components of support 10, that are described herein, can be constructed of a wide variety of materials to suit the environment and load capacities to which support 10 will be subjected.

Figure 2:
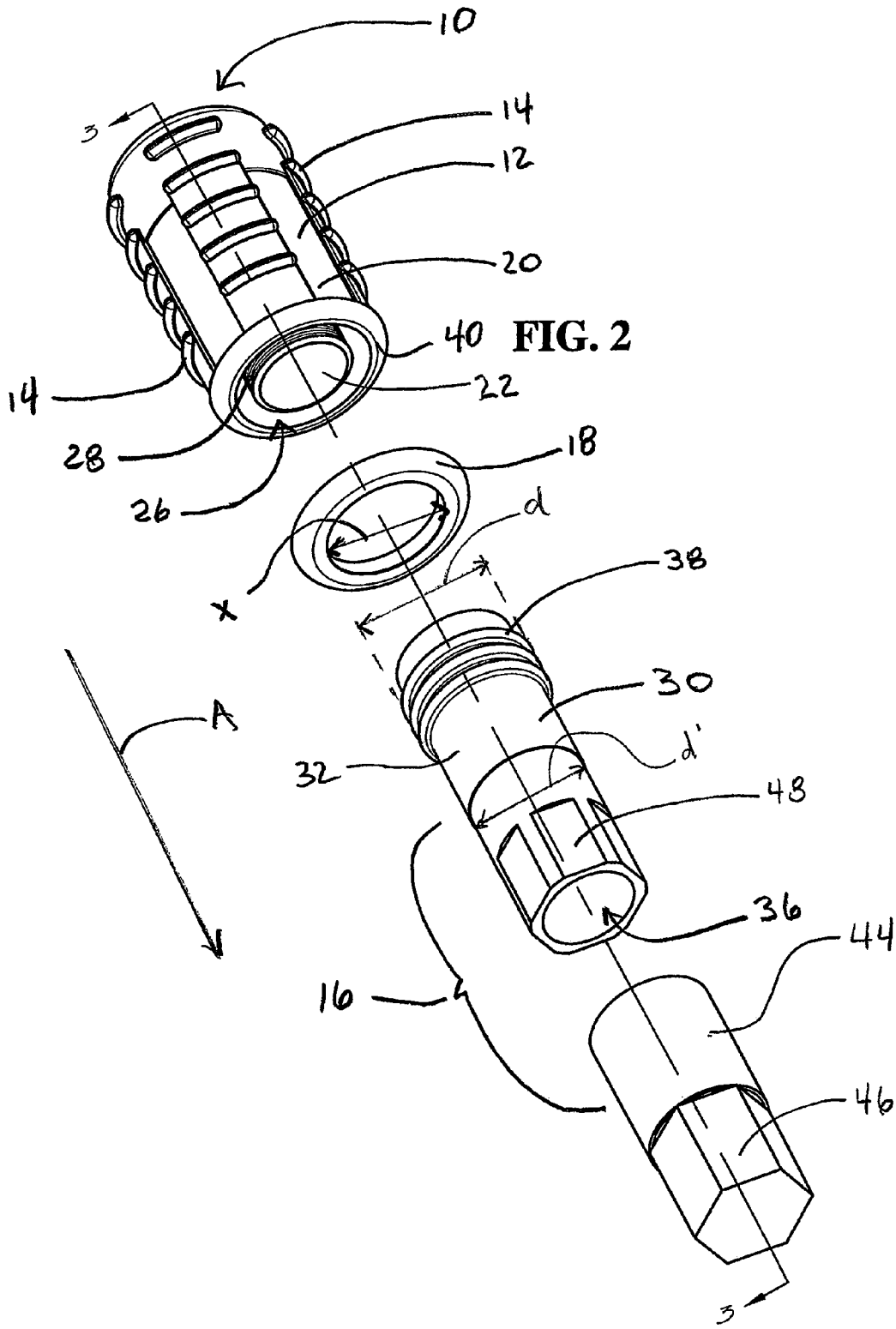
FIG. 2 is an exploded perspective view of the adjustable support assembly.
Figure 3:
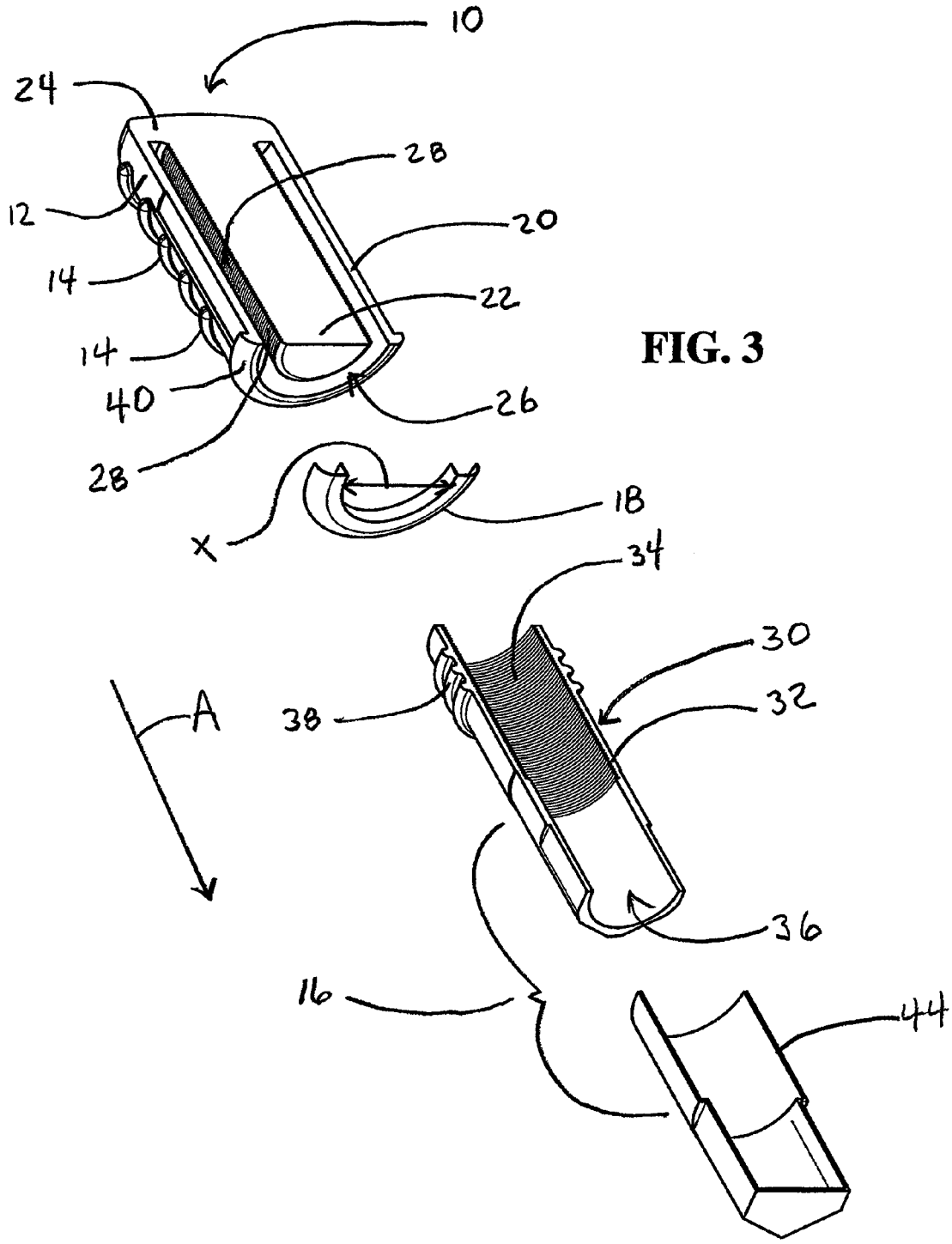
FIG. 3 is a cross sectional exploded view of the adjustable support assembly taken along line 3-3 in FIG. 2.
Figure 4:
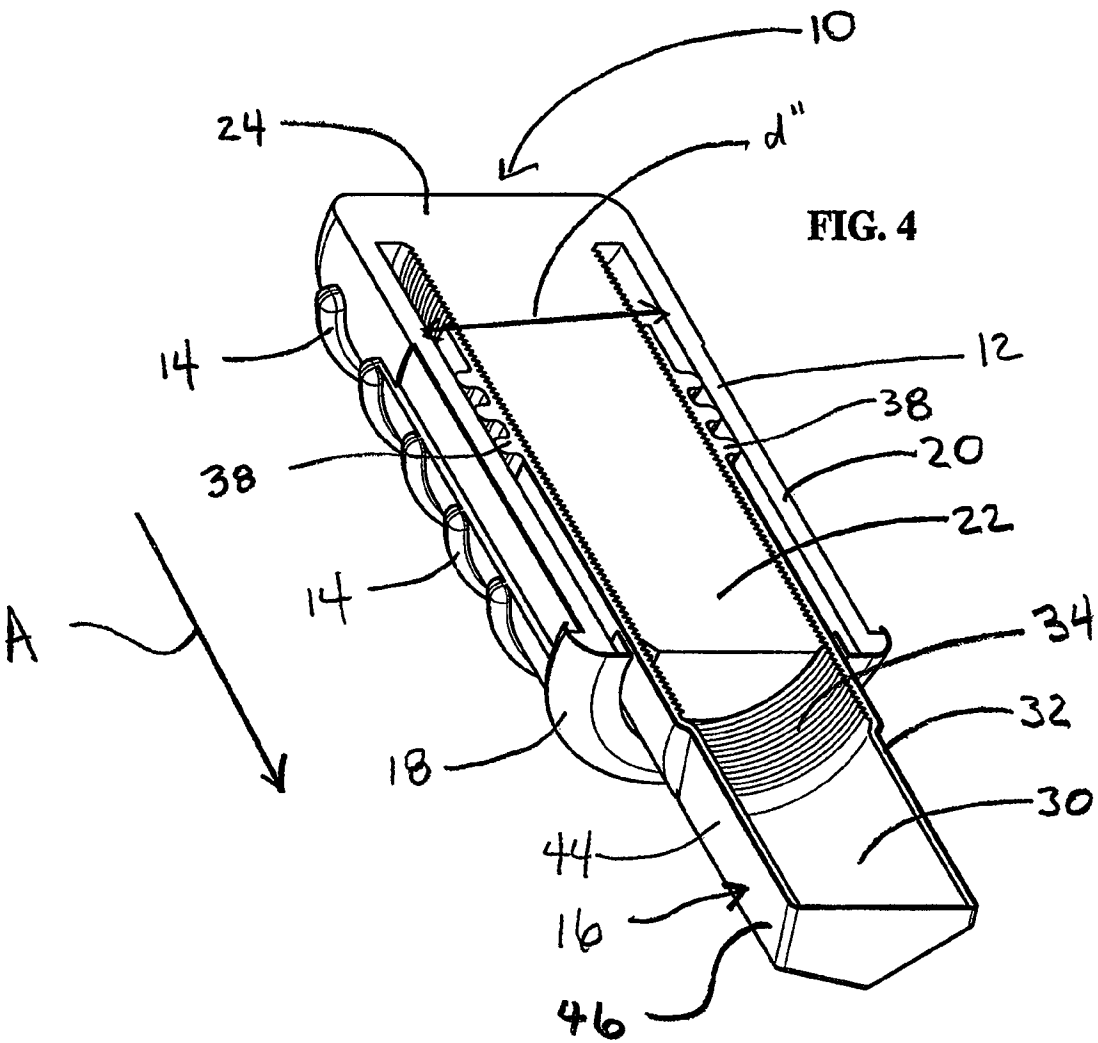
FIG. 4 is a perspective of a cross sectional view of the adjustable support assembly taken along line 4-4 in FIG. 1.

A more detailed view of the construction of adjustable support 10 can be seen in FIGS. 2-4. As is shown, housing 12 is constructed of sidewall 20 providing a generally hollow construction for housing 12 and forms an opening 26 at the bottom of housing 12. Column 22 is, in this example, positioned centrally within hollow housing 12 and spaced apart from sidewall 20. Column 22 extends from end wall 24 of housing 12 to generally opening 26 positioned at a lower end of housing 12. End wall 24 is, in this example, connected to sidewall 20 and is integrally formed therewith. Column 22 is secured to end wall 24 through any number of common methods of securement, such as being integrally molded, glued or sonically welded or the like to end wall 24.

In this example, column 22 is constructed of the polypropylene discussed herein. However, as mentioned earlier, this component can be constructed of, in part or entirely of a suitable metal such as stainless steel, aluminum or the like. Column 22 is formed in a generally solid cylindrical shape. The exterior surface of column 22 defines threads 28. The spacing of threads 28 can be made to suit the needs of the particular support 10. In this example, the threads are fourteen (14) per inch. Also, in this example, threads 28 extend substantially the entire length of column 22 but may be positioned along column 22 where desired for the needs of adjustable support 10.

Leg assembly 16 includes leg 30 which, in this example, is constructed of polypropylene, as mentioned above. Again, the material to be used in the construction of leg 30 may be selected to suit the load capacities to be experienced by support 10. Leg 30 is constructed of another sidewall 32. In this example, leg 30 is constructed of a hollow and generally cylindrical shape forming opening 36 within leg 30 wherein other threads 34 are defined on an interior surface of sidewall 32 within opening 36 of leg 30 and are positioned along at least a portion of the interior portion of sidewall 32 of leg 30.

Other threads 34 of leg 30 are constructed and dimensioned to be compatible with threads 28 of column 22. Threads 28 and 34 because of their compatible dimensions, engage one another and permitting leg 30 to move upwardly or downwardly, depending on the direction leg 30 is turned, on column 22. Thus, the length of leg 30 which extends outside of housing 12 can be adjusted as desired, thereby changing the elevation of the furniture or equipment to which support 10 is connected. Again, as described earlier for threads 28, other threads 34 may be positioned where desired, along the length of leg 30, to address the needs of support 10.

An upper portion of leg 30 forms a greater width dimension "d" than a lower portion of leg 30 which forms a width dimension "d'", as seen in FIG. 2. In this example, wall member 38 forms a ring around the exterior of leg 30 and as can be seen, three rings spaced apart along the length of leg 30 are employed which forms the width dimension "d". Wall member 38, in this example, is integrally formed with housing 12, but can be positioned on an exterior surface of housing 12 by a number commonly known methods. Dimension "d" is selected to be only slightly smaller than dimension "d"" of the opening within housing 12 between opposing interior surfaces of sidewall 20. This differential in dimension allows the upper portion of leg 30 to be inserted into housing 12 and permits wall member or spaced apart rings 38 to be positioned proximate to the opposing interior surfaces of housing 12. Positioning wall member 38 proximate to the opposing interior surfaces of housing 12 provides the ability of easily moving leg 30 up and down as desired within housing 12 without unnecessary resistance, while at the same time providing lateral stability of leg 30 within housing 12.

The dimension "d" of leg 30 at wall member 38 additionally serves the purpose of limiting the travel of leg 30 in the direction indicated by arrow A, seen in FIGS. 2-4. Once leg 30 is engaged with column 22 and wall members 38, with the greater width dimension "d", are positioned within housing 12, annular ring 18 is secured to bottom rim 40 of housing 12. A portion of annular ring 18 is positioned to extend over opening 26 of housing 12 thereby reducing the dimension of access to the interior of housing 12 to dimension "x" which is the diameter of opening 42 of annular ring 18. Dimension "x" of opening 42 is less than width dimension "d" of the upper portion of leg 30 at wall member 38. Thus, as leg 30 travels in direction A, it will stop moving in that direction when upper portion of leg 30 or wall member 38 of width dimension "d" is blocked by annular ring 18 because the opening of annular ring 18 has dimension "x" which is less than dimension "d". Thus, in the example shown, leg 30 may travel in direction A to the extent permitted until upper portion of leg 30 with width dimension "d" comes into contact with annular ring 18. In moving leg 30 in the opposite direction, the travel of leg 30 is limited to when the upper end of leg 30 contacts end wall 24 of housing 12.

Leg assembly 16 includes leg cover 44. Leg cover 44, in this example, is constructed of metal. Cover 44 provides protection for leg 30 and a base with more area for distribution of weight than that of leg 30. Flattened portions 46 are positioned in a lower portion of cover 44. Corresponding flattened portions 48 are provided in the lower portion of leg 30. With cover 44 positioned over leg 30, flattened portions 46 and 48 are overlying one another. This configuration permits one to grasp cover 44 to turn cover 44 and thereby cause leg 30 to likewise turn. This configuration allows one to adjust the length of leg assembly 16 and thereby adjust the elevation of the furniture or equipment to which support 10 is connected without having to remove cover 44 to turn leg 30.

It should be understood that the preceding is merely a detailed description of various embodiments of this invention and that numerous changes to the disclosed embodiments can be made in accordance with the disclosure herein without departing from the spirit or scope of the invention. The preceding description, therefore, is not meant to limit the scope of the invention. Rather, the scope of the invention is to be determined only by the appended claims and their equivalents.

I claim:

1. An adjustable support, comprising:

a housing which comprises a sidewall wherein a column is positioned within the housing and spaced apart from the sidewall wherein the column defines threads;

a leg comprising another sidewall which defines other threads wherein the other threads are dimensioned to engage the threads defined by the column;

an end wall connected to the sidewall of the housing; and rib members defined on an exterior surface of the housing adapted to engage a sidewall within an opening defined in one of a piece of furniture and a piece of equipment.

2. The adjustable support of claim 1 wherein the column is connected to the end wall.

3. The adjustable support of claim 1 wherein the other sidewall of the leg defines an opening in the leg wherein the other threads are defined on an interior surface of the other sidewall within the opening.

4. The adjustable support of claim 1 wherein the housing is constructed of a polypropylene.

5. The adjustable support of claim 1 wherein the sidewall is constructed of a thickness in the range of about 0.080" to 0.100".

6. The adjustable support of claim 1 wherein the sidewall of the housing defines an opening in the housing.

7. An adjustable support, comprising:

a housing which comprises a sidewall wherein a column is positioned within the housing and spaced apart from the sidewall wherein the column defines threads, wherein the sidewall of the housing defines an opening in the housing;

a leg comprising another sidewall which defines other threads wherein the other threads are dimensioned to engage the threads defined by the column;

an end wall connected to the sidewall of the housing; and an annular ring positioned and secured around a perimeter of the opening of the housing and wherein a portion of the ring extends over a portion of the opening forming a reduced dimension of the opening.

8. The adjustable support of claim 7 wherein the annular ring is constructed of metal.

9. The adjustable support of claim 7 wherein an upper portion of the leg comprises a greater width dimension than a lower portion of the leg.

10. An adjustable support, comprising:

a housing which comprises a sidewall wherein a column is positioned within the housing and spaced apart from the sidewall wherein the column defines threads; and a leg comprising another sidewall which defines other threads wherein the other threads are dimensioned to engage the threads defined by the column;

wherein an upper portion of the leg comprises a wall member extending from an exterior surface of the other sidewall of the leg positioned within an upper portion of the leg; and wherein the wall member comprises at least one ring positioned around the exterior of the leg.

11. The adjustable support of claim 10 wherein two rings are positioned spaced apart along a length of the leg.

12. The adjustable support of claim 10 wherein the wall member extends outwardly from the upper portion of the leg and is positioned proximate to the sidewall of the housing with the upper portion of the leg positioned within the housing.

13. An adjustable support, comprising:

a housing which comprises a sidewall wherein a column is positioned within the housing and spaced apart from the sidewall wherein the column defines threads;

a leg comprising another sidewall which defines other threads wherein the other threads are dimensioned to engage the threads defined by the column;

an end wall connected to the sidewall of the housing; and a metal sleeve positioned to cover a lower portion of the leg.

14. The adjustable support of claim 13 wherein each of the sleeve and lower portion of the leg form a flattened portion wherein the flattened portion of the sleeve overlies the flattened portion of the leg.

* * * * *